United States Patent [19]

Isomura

[11] Patent Number: 4,838,590

[45] Date of Patent: Jun. 13, 1989

[54] INSIDE HANDLE DEVICE FOR VEHICLE

[75] Inventor: Yukio Isomura, Chiryu, Japan

[73] Assignee: Aisin Seiki Kabushiki Kaisha, Japan

[21] Appl. No.: 102,729

[22] Filed: Sep. 30, 1987

[30] Foreign Application Priority Data

Sep. 30, 1986 [JP] Japan ..... 61-149873[U]

[51] Int. Cl.[4] ..... E05B 3/00

[52] U.S. Cl. ..... 292/336.3; 292/DIG. 31

[58] Field of Search ..... 292/336.3, DIG. 31, 292/DIG. 38, DIG. 53, 113; 70/452; 16/380, 381, 386; 411/517, 519

[56] References Cited

U.S. PATENT DOCUMENTS

| | | | |
|---|---|---|---|
| 636,331 | 11/1899 | Glover | 16/381 |
| 643,045 | 2/1900 | Denis | 411/517 |
| 1,175,550 | 3/1916 | Murray | 16/380 X |
| 3,766,599 | 10/1973 | Ullman, Jr. . | |
| 4,135,273 | 1/1979 | Holmes | 16/381 |
| 4,175,315 | 11/1979 | Hayes, Sr. et al. | 16/380 X |
| 4,475,266 | 10/1984 | Suska | 16/380 X |
| 4,573,239 | 3/1986 | Valenti et al. | 16/386 X |
| 4,580,822 | 4/1986 | Fukumoto | 292/336.3 |
| 4,681,357 | 7/1987 | Uemura et al. | 292/DIG. 31 X |
| 4,778,207 | 10/1988 | Gergoe | 292/DIG. 31 X |

FOREIGN PATENT DOCUMENTS

| | | | |
|---|---|---|---|
| 59-16447 | 5/1984 | Japan . | |
| 59-134654 | 8/1984 | Japan . | |
| 789599 | 1/1958 | United Kingdom | 411/519 |

*Primary Examiner*—Lloyd A. Gall
*Assistant Examiner*—Curtis B. Brueske
*Attorney, Agent, or Firm*—Finnegan, Henderson, Farabow, Garrett & Dunner

[57] ABSTRACT

An inside handle device for a vehicle comprises a bracket, a handle disposed inside the bracket, a locking knob disposed inside the handle, and a single hinge pin for rotatably pivoting the handle and the locking knob inside both side portions of the bracket. The hinge pin has a circumferential groove formed therein. One of the bracket, handle and locking knob has elastic pawls projecting toward the hinge pin which are engaged in the groove of the hinge pin to prevent the hinge pin from shifting axially. Each elastic pawl has notches at its root portion to allow easy elastic deformation thereof. Around the hinge pin is disposed a torsion spring whose one end is locked on the bracket with the other end on the handle.

7 Claims, 4 Drawing Sheets

INSIDE HANDLE DEVICE FOR VEHICLE

BACKGROUND OF THE INVENTION

1. Field of the Invention

This invention relates to an inside handle device for vehicles and, more particularly, to those useful as the inside handle device for opening and closing the door of an automobile.

2. Description of the Prior Art

One conventional type of such devices is disclosed in Japanese Utility Model Laid-Open No. 59-134654 which is shown in FIG. 7. This type is featured in that two hinge pins 5*a* and 5*b* are inserted from the inside into the respective holes of a locking knob 2, handle 2 and casing 1 serving also as a bracket, and that a spring 4 is included to urge the collar portions of the hinge pins 5*a* and 5*b* against the locking knob 3, thereby these five members being assembled into a single body.

In the aforementioned conventional device, the spring while being compressed must be fitted to the hinge pins within a space confined by the locking knob, thus increasing the time needed for assembly.

SUMMARY OF THE INVENTION

Therefore, it is the object of the present invention to provide an inside handle device for vehicles which can be assembled in a short time.

To achieve the foregoing object and in accordance with the purpose of the invention, as embodied and broadly described herein, the inside handle device of this invention comprises a bracket to be secured to a door of a vehicle, the bracket having side portions formed thereon, a handle disposed inside the bracket, a locking knob disposed inside the handle, and a single hinge pin extending between the side portions of the bracket for pivotally mounting the handle and the locking knob within the bracket, the hinge pin having a circumferential groove formed therein, a plurality of elastic pawls formed in the handle device and projecting toward the hinge pin, the elastic pawls being engaged in the groove of the hinge pin such that the hinge pin is prevented from shifting axially, and each of the elastic pawls being formed between notches to permit the pawls to be easily deformed;

In assembling, the respective holes of the bracket, handle and locking knob are aligned mutually, and the hinge pin is inserted into these holes from the outside, so that the elastic pawls formed on one out of the bracket, handle and locking knob are fitted in the groove formed in the hinge pin just inserted, thereby simply resulting in a single body made up of the bracket, handle and locking knob.

In the foregoing process, since each elastic pawl is formed by the notches, the elastic pawl is easily deformed by the pin yet affirmatively returns to its original position and fits. in the groove of the hinge pin.

The accompanying drawings, which are incorporated in and constitute a part of this specification, illustrate one embodiment of the invention and, together with the description, serve to explain the principles of the invention.

DESCRIPTION OF THE PREFERRED EMBODIMENT

Figure 7:
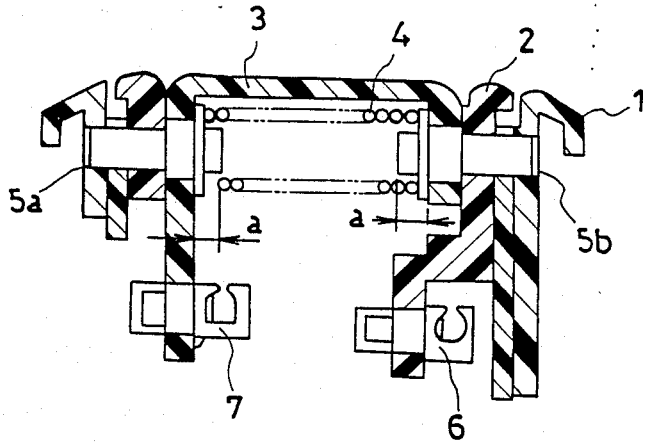
FIG. 7 is a sectional view of a conventional inside handle device, corresponding to FIG. 2.

An embodiment of the present invention will now be described with reference to the drawings wherein the same reference numerals designate identical members to those of the conventional device shown in FIG. 7.

Figure 1:
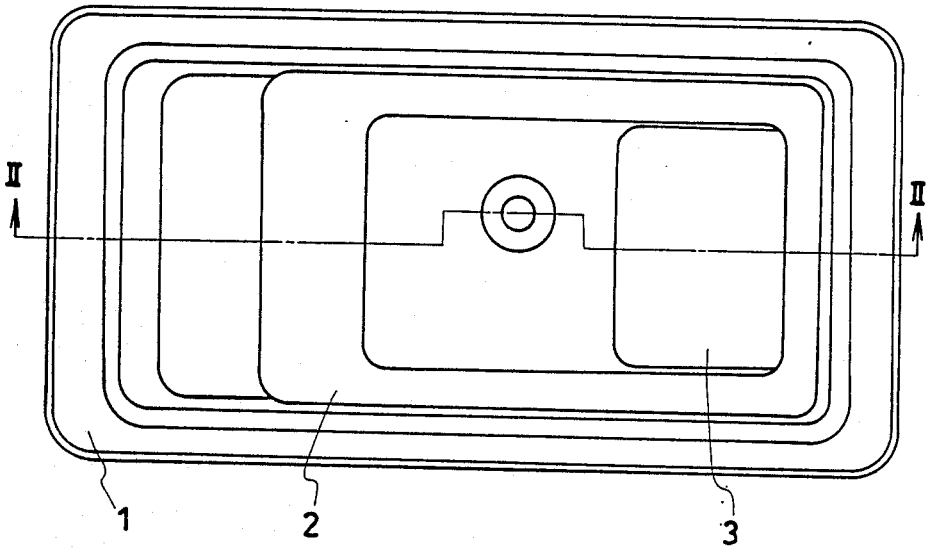
FIG. 1 is a plan view of a bezel (bracket) assembled with a locking knob and a handle according to the present invention.
Figure 2:
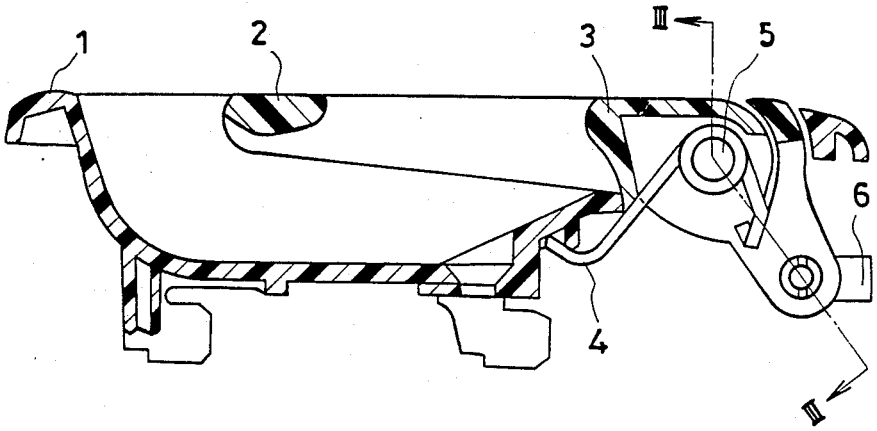
FIG. 2 is a sectional view taken along line II—II in FIG. 1.
Figure 3:
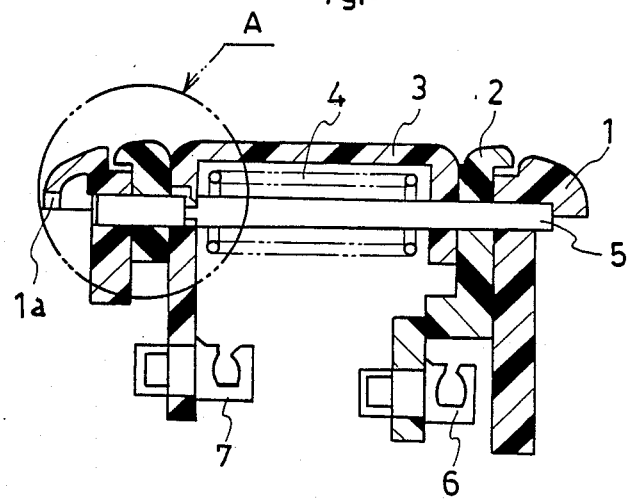
FIG. 3 is a sectional view taken along line III—III in FIG. 2.

In an inside handle device shown in FIGS. 1 through 3 which includes a bezel-integrated type locking knob, a handle 2 disposed inside a bezel 1 serving also as a bracket has a clip 6 fitted in its end portion which clip is to be interlinked to a rod (not shown) connected to a latch mechanism of a door lock device. A locking knob 3 has a clip 7 fitted in its end portion which clip is to be interlinked to a rod (not shown) connected to a lock mechanism of the door lock device. Both members, the handle 2 and the locking knob 3, are rotatably pivoted by a hinge pin 5 inside the bezel 1. Around the hinge pin 5 is wound and disposed a to torsion spring 4 whose one end is locked on the back side of the bezel 1 with the other end on the handle 2. As a result, the handle 2 is maintained in the state shown in FIG. 2.

Figure 4:
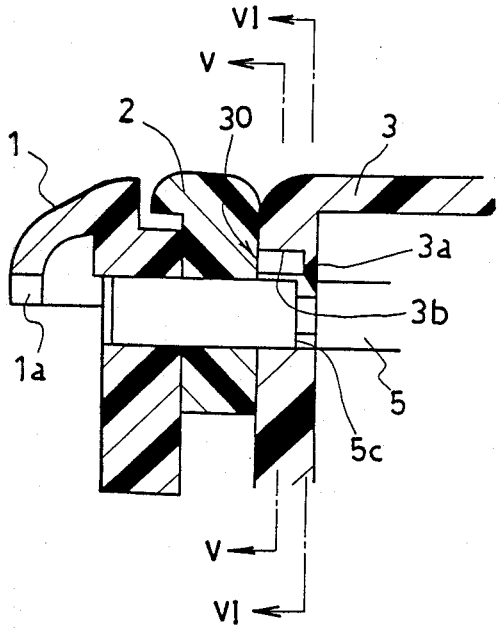
FIG. 4 is an enlarged view of a portion A of FIG. 3.

Both, upper and lower side portions of each of the handle 2, locking knob 3 and bezel 1 have holes of the same diameter bored therein through which the hinge pin 5 passes. The hole formed in one side portion of the locking knob 3 has elastic pawls 3*a*, and the hinge pin 5 has a circumferential groove 5*c* formed therein in which the elastic pawls 3*a* are fitted (see FIGS. 3 and 4).

Figure 5:
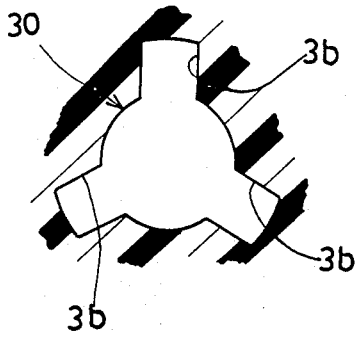
FIGS. 5 and 6 are sectional views taken along line V—V and line VI—VI, respectively, in FIG. 4.
Figure 6:
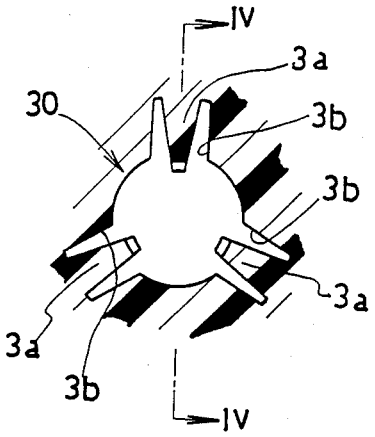

As shown in FIGS. 5 and 6, a check hole 30 for formation of the elastic pawls 3*a* includes three notches 3*b* extending radially outward from a surface for rotatably supporting the hinge pin 5. Each of the three notches 3*b* is elongate in the axial direction of the hinge pin 5, and they are symmetrically disposed around the axis. In the right-hand end portion of each notch 3*b* (FIG. 4), an elastic pawl 3*a* projects from the peripheral margin of the notch 3*b* toward the hinge pin 5. Thus, the elastic pawl 3*a* is elastically deformable within the notch 3*b*.

In addition, since the peripheral margin of each notch 3*b* acts as the starting point of elastic deformation of each elastic pawl 3*a*, the elastic pawls 3*a* can deform easily.

Incidentally, the under side of the outer portion of the bezel 1 has a semicircular cutout la formed therein such that the hinge pin 5 can be inserted into the holes from the outside.

The assembly process of the embodiment thus configured of the present invention will now be described.

The torsion spring 4 is disposed inside the locking knob 3 such that its wound section is concentric with the holes of the locking knob 3. Of course, at this time the torsion spring 4 is compressed in the direction of winding of its wound section. In this connection, since the present invention involves no elongation corresponding to an expansion amount a, a appearing as shown in FIG. 7 when each hinge pin 5*a*, 5*a* of the conventional device is inserted into the corresponding holes, the torsion spring 4 of the present invention is not contracted in the axial direction of its wound section, thus, it can be disposed easily.

In the next step, the handle 2 is disposed inside the bezel 1 such that the holes of the handle 2 and the bezel 1 are mutually concentric, and the locking knob 3 is disposed inside both members and whose holes are also concentric.

In the subsequent step, the hinge pin 5 is inserted from the under side of the bezel 1 into the holes of the bezel 1, handle 2 and locking know 3 and into the wound section of the torsion spring 4, all maintained in concentric relation, in such a direction that the pawls 3*a* of the locking knob 3 and the groove 5*c* of the hinge pin 5 occupy the same position.

Because the locking knob 3 with the pawls 3*a* is made of resin, the pawls 3*a* deform owing to their elasticity when the hinge pin 5 is inserted, and recover their original posture when the groove 5*c* of the hinge pin 5 has come to the position of the pawls 3*a*. As a result, the groove 5*c* comes to engagement with the pawls 3*a* (as illustrated by the solid lines in FIG. 4). In this stage, the axial movement of the hinge pin 5 is restricted, and these five members take the form of a single body, hence, the assembly process is complete.

As will be appreciated from the foregoing, the assembly process of the present invention can be completed in a short time, hence, the object of the present invention is accomplished.

Figure 8:
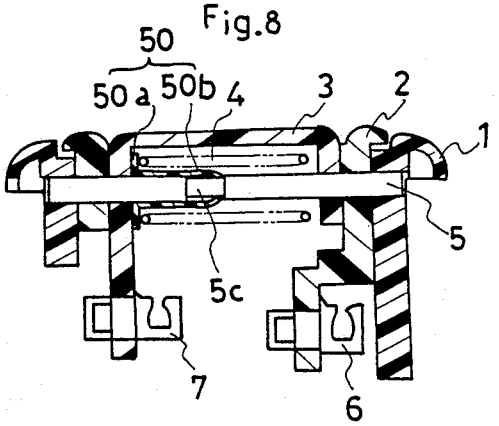
FIG. 8 is a sectional view corresponding to FIG. 3 which shows a comparison example.

As other measures to solve the problem of the prior art, such a structure as shown in FIG. 8 would be devised in which a clip 50 is disposed around the hinge pin 5 inside the locking knob 3, pawls 50*b* provided at one end of the clip 50 are engaged with the groove 5*c* of the hinge pin 5 to make the clip 50 and the hinge pin 5 into the form of a single body, and a head 50*a* at the other end of the clip 50 is made to abut on the locking knob 3.

Figure 9:
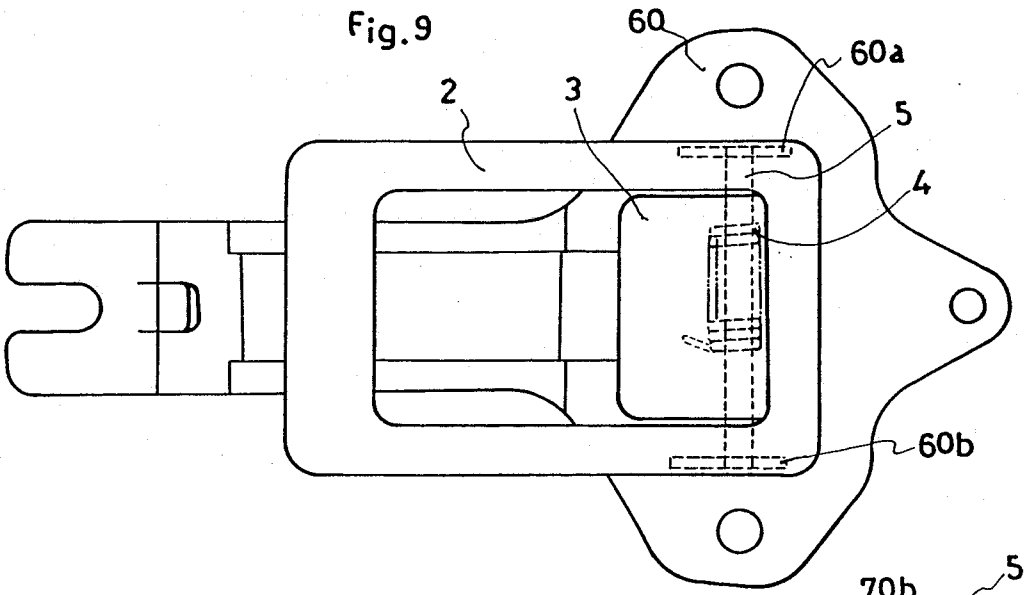
FIGS. 9 and 10 are a plan view and a sectional view corresponding to FIG. 1 and FIG. 3, respectively, which show another comprarison example.
Figure 10:
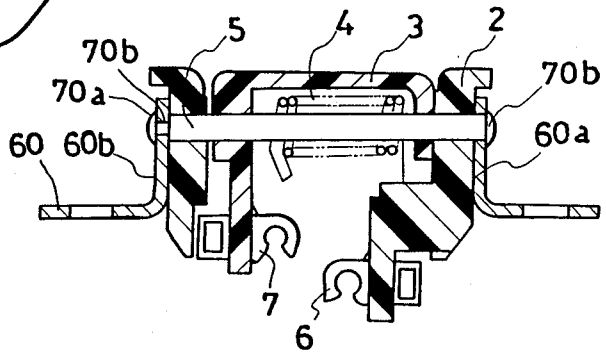

Or, such a structure as shown in FIGS. 9 and 10 would also be devised in which a bracket 60 to which the locking knob 3 and the handle 2 are to be attached is made of metal, and both ends 70*a* and 70*b* of the hinge pin 5 are crimped to leftside and rightside attaching portions 60*a* and 60*b* of the bracket.

However, the device shown in FIG. 8 needs the clip 50 additionally. Thus, its structure becomes more complicated and its assembly work becomes troublesome. Similarly, the device shown in FIGS. 9 and 10 has the hinge pin whose ends are crimped, thus, its assembly work becomes troublesome. Further, the bracket 60 must posssess a strength sufficient for crimping of the ends of the hinge pin, thus making it unsuitable as the bezel.

To the contrary, according to the present invention, since the assembly process is completed only by inserting the single hinge pin into the upper and lower holes of the bracket, locking knob and handle, there is the merit that the assembly process can be accomplished in a short time. Further, because of the foregoing structure, the looseness of the handle and the locking knob can be lessened and their strength can be increased. Furthermore, with the would section of the handle-urging spring having the hinge pin passing therethrough, there results in a secondary effect of preventing the spring from working out of the hinge pin.

What is claimed is:

1. An inside handle device for a vehicle comprising
a bracket to be secured to a door of the vehicle, said bracket having side portions formed thereon,
a handle disposed inside said bracket,
a locking knob disposed inside said handle, and
a single hinge pin extending between the side portions of said bracket for pivotally mounting said handle and said locking knob within said bracket,
said hinge pin having a circumferential groove formed therein,
a plurality of elastic pawls formed in said handle device and projecting toward said hinge pin,
said elastic pawls being engaged in said groove of said hinge pin such that said hinge pin is prevented from shifting axially, and
each of said elastic pawls being formed between notches to permit said pawls to be easily deformed.

2. An inside handle device according to claim 1, further including a torsion spring having a wound portion and two ends, said wound portion being disposed around said hinge pin inside said locking knob, and one end of the torsion spring engaging the back side of said bracket and the other end engaging said handle.

3. An inside handle device according to claim 1, wherein the number of said elastic pawls is three, said elastic pawls being symmetrically disposed around said hinge pin.

4. An inside handle device according to claim 1, wherein said notches are formed on either side of each of said elastic pawls.

5. An inside handle device according to claim 1, wherein said locking knob is made of resin.

6. An inside handle device according to claim 1, wherein said handle, said locking knob and said bracket have holes of the same diameter through which said hinge pin passes.

7. An inside handle device according to claim 1, wherein said elastic pawls are formed on said locking knob.

* * * * *